United States Patent [19]

Tani et al.

[11] 4,078,937

[45] Mar. 14, 1978

[54] PROCESS FOR SENSITIZING A FINE GRAIN SILVER HALIDE PHOTOGRAPHIC EMULSION

[75] Inventors: Tadaaki Tani; Shigeharu Urabe, both of Minami-ashigara, Japan

[73] Assignee: Fuji Photo Film Co., Ltd., Minami-ashigara, Japan

[21] Appl. No.: 795,266

[22] Filed: May 9, 1977

Related U.S. Application Data

[63] Continuation-in-part of Ser. No. 635,503, Nov. 26, 1975, abandoned.

[30] Foreign Application Priority Data

Nov. 26, 1974 Japan ..... 49-136907

[51] Int. Cl.[2] ..... G03C 1/28

[52] U.S. Cl. ..... 96/107; 96/109; 96/94 R

[58] Field of Search ..... 96/94 R, 107, 109, 95, 96/108

[56] References Cited

U.S. PATENT DOCUMENTS

| | | | |
|---|---|---|---|
| 2,835,581 | 5/1958 | Tinker et al. | 96/107 |
| 3,501,313 | 3/1970 | Willems et al. | 96/107 |
| 3,655,394 | 4/1972 | Illingsworth | 96/94 R |
| 3,671,258 | 6/1972 | Taber | 96/109 |
| 3,784,381 | 1/1974 | Perignon | 96/94 R |
| 3,915,713 | 10/1975 | Shiba et al. | 96/107 |

*Primary Examiner*—Won H. Louie, Jr.

*Attorney, Agent, or Firm*—Sughrue, Rothwell, Mion, Zinn and Macpeak

[57] ABSTRACT

A process for preparing a sulfur-sensitized silver halide photographic emulsion whose average grain size does not exceed 0.5 μm, which comprises forming the silver halide grains in the presence of ammionia and incorporating therein at least one hydroxytetrazaindene compound represented by the following general formula (I) or (II):

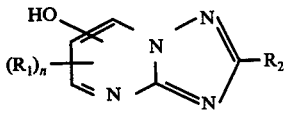

(I)

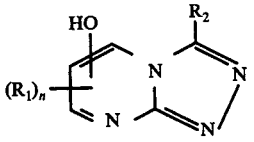

(II)

wherein $R_1$ and $R_2$ each represents a hydrogen atom, an aliphatic group or an aromatic group, and $n$ represents 1 or 2; to thereby increase sensitivity.

23 Claims, No Drawings

PROCESS FOR SENSITIZING A FINE GRAIN SILVER HALIDE PHOTOGRAPHIC EMULSION

CROSS REFERENCE TO RELATED APPLICATIONS

This application is a continuation-in-part application of copending application, Ser. No. 635,503, filed Nov. 26, 1975, now abandoned.

BACKGROUND OF THE INVENTION

1. Field of the Invention

The present invention relates to a process for preparing a silver halide photographic emulsion having enhanced sensitivity and, more particularly, to a process for preparing a sulfur-sensitized fine grain silver halide photographic emulsion having enhanced sensitivity.

2. Description of the Prior Art

One long pursued object of the art has been to further raise the sensitivity of silver halide photographic emulsions. Another object has been to make the grains in a silver halide photographic emulsion finer in order to improve the graininess or sharpness of photographic light-sensitive materials. However, as grains become finer, sensitivity becomes lower. Thus, it has been particularly desired with fine grain photographic emulsions to raise the sensitivity thereof.

On the other hand, it is of extreme importance to control the fogging of silver halide photographic emulsions. Various compounds have been used for this purpose.

Hydroxytetrazaindene compounds are known as stabilizers for photographic emulsions and have been incorporated in an emulsion in order to reduce the fog thereof. However, these compounds are also known to often reduce photographic sensitivity (see, for example, the paper of V. C. Chambers in *Phot. Sci. Eng.*, Vol. 3, 6, pp. 268 – 271 (1959), entitled *A Correlation of the Chemical Structures of Some Triazolopyrimidines with Their Photographic Effects).*

We earlier discovered that the sensitivity of a silver halide emulsion can be markedly raised by incorporating a sulfur-containing compound and a hydroxytetrazaindene compound in combination in a monodispersed silver halide emulsion containing cubic grains (silver bromide content: not less than 80 mol%) as we described in Japanese Patent Application 46,398/73.

It is further known that the incorporation of a substituted tetrazaindene compound in a silver halide light-sensitive material containing 20 mol% or more silver chloride causes contrasty sensitization (see Japanese Patent Application (OPI) No. 11,122/74).

SUMMARY OF THE INVENTION

We have now surprisingly discovered that photographic sensitivity is markedly enhanced, regardless of the form of the silver halide grains, by adding a certain kind of hydroxytetrazaindene compound to a sulfur-sensitized silver halide photographic emulsion containing silver halide grains of not greater than 0.5 μm in average grain size (average particle diameter) formed in the presence of ammonia.

One object of the present invention is to provide a process for preparing a silver halide photographic emulsion having enhanced sensitivity.

Another object of the present invention is to provide a process for preparing a fine grain silver halide photographic emulsion having enhanced sensitivity.

A further object of the present invention is to provide a process for controlling fogging of a silver halide photographic emulsion and for enhancing the sensitivity thereof.

The above-described objects of the present invention can be attained by a process which comprises forming the silver halide grains of an average size not greater than 0.5 μ in the presence of ammonia ($NH_3$) in a concentration of at least 10 mg/l at a pH of 8 to 10 and at a pAg of 7 to 10 and incorporating in the silver halide emulsion containing the thus formed silver halide grains, at least one hydroxytetrazaindene compound represented by general formula (I) or (II):

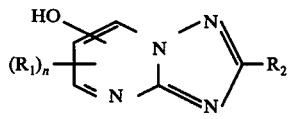

(I)

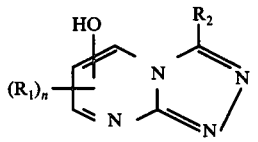

(II)

wherein $R_1$ and $R_2$ each represents a hydrogen atom, an aliphatic group or an aromatic group; and *n* is 1 or 2, thereby enhancing emulsion sensitivity.

DETAILED DESCRIPTION OF THE INVENTION

In the above general formulae (I) and (II), more preferably, $R_1$ and $R_2$, which may be the same or different, each represents a hydrogen atom, an aliphatic group having 1 to 32 carbon atoms {which term includes, e.g., an alkyl group having 1 to 10 carbon atoms, preferably 1 to 6 carbon atoms (e.g., a methyl group, an ethyl group, a propyl group, a pentyl group, a hexyl group, an octyl group, an isopropyl group, a sec-butyl group, a t-butyl group, a cyclohexyl group, a cyclopentylmethyl group, a decyl group, etc.); an alkyl group having 1 to 10 carbon atoms, preferably 1 to 4 carbon atoms substituted with one or two aryl groups (e.g., a benzyl group, a phenethyl group, a benzhydryl group, a 1-naphthylmethyl group, a 3-phenylbutyl group, etc.); an alkoxy-substituted alkyl group having 1 to 10 carbon atoms, preferably 1 to 4 carbon atoms, in the alkyl and alkoxy moieties (e.g., a methoxymethyl group, a 2-methoxyethyl group, a 3-ethoxypropyl group, a 4-methoxybutyl group, etc.); an alkyl group substituted by a hydroxy group or a carbonyl group, which alkyl group has 1 to 12 carbon atoms, preferably 1 to 5 carbon atoms (e.g., a hydroxymethyl group, a 2-hydroxyethyl group, a 3-hydroxybutyl group, a carboxymethyl group, a 2-carboxyethyl group, etc.); an alkoxycarbonyl-substituted alkyl group having 1 to 10 carbon atoms, preferably 1 to 5 carbon atoms, in each alkyl and alkoxycarbonyl group (e.g., a 2-(methoxycarbonyl)ethyl group, a 3-(pentoxycarbonyl)butyl group, etc.) or the like}; or an aromatic group having 6 to 30 carbon atoms {e.g., an aryl group (e.g., a phenyl group, a 1-naphthyl group, etc.), which term includes a substituted aryl group with one or more alkyl groups having 1 to 10 carbon atoms, preferably 1 to 3 carbon atoms (e.g., a p-tolyl group, an m-ethylphenyl group, an m-cumenyl group, a mesityl group, a 2,3-xylyl group, a 1-methyl-2-naphthyl group, etc.); one or more halogen atoms such as chlorine, bromine or iodine (e.g., a p-chlorophenyl group, an o-bromophenyl group, etc.); one or more hydroxy groups (e.g., a p-hydroxyphenyl group, a 1-hydroxynaphthyl group, etc.); one or more alkoxy groups having 1 to 10, preferably 1 to 3 carbon atoms (e.g., an m-methoxyphenyl group, a p-ethoxyphenyl group, a p-isopropoxyphenyl group, etc.); one or more carboxy groups (e.g., a p-carboxyphenyl group, a 4-carboxynaphthyl group, etc.); one or more alkoxycarbonyl groups having 1 to 10, preferably 1 to 3, carbon atoms (e.g., an o-methoxycarbonylphenyl group, an m-ethoxycarbonylphenyl group, etc.) or the like}; and $n$ represents 1 or 2. When $n$ is 2 and $R_1$ is an alkyl group, such alkyl group may be in the form of cyclic chain.

The silver halide emulsions used in the present invention can be prepared by various conventional processes (see, e.g., T. H. James, *The Theory of the Photographic Process,* 3rd Ed., pp. 31 – 44, The Macmillan Co., New York (1966)). The silver halide emulsion may be or may not be physically ripened, as desired. After formation of a silver halide precipitate or physical ripening, soluble salts are usually removed from the emulsion by a number of conventional processes, e.g., a noodle-washing process or a flocculation process utilizing an inorganic salt having a multivalent anion (e.g., ammonium sulfate), an anionic surface active agent, an anionic polymer (e.g., polystyrenesulfonic acid), or a gelatin derivative (e.g., an aliphatic or aromatic acylated gelatin). With some processes for preparing emulsions (for example, producing silver halide grains at a high pAg value), the soluble salt-removing process may be omitted.

To the thus obtained emulsion there is added a sulfur-containing compound to chemically ripen the same, preferably at a temperature of about 40° to about 75° C, most preferably 50° to 60° C, for about 5 to about 180 minutes, most preferably 20 to 100 minutes, and at a pH of about 5 to about 8, most preferably 6 to 7, and at least one hydroxytetrazaindene compound represented by the foregoing general formulae (I) or (II) is added thereto. The ripening of the emulsion may be continued after the addition. The above-mentioned hydroxytetrazaindene compound may be added at any stage, i.e., before, during or after the above-described chemical ripening, but preferably substantially after the sulfur-sensitization.

The silver halide contained in an emulsion used in the present invention suitably has an average grain size of not greater than 0.5 μm, preferably not greater than 0.35 μm and, particularly, less than 0.3 μm. The silver halide grains used in this invention, however, are preferably formed by the so-called double-jet method, especially the so-called controlled double-jet method whereby the silver-ion concentration in the reaction system (i.e., the solution containing the silver halide grains) is maintained at a fixed value. In this method, the silver halide grains are formed and grown under a constant silver-ion concentration. The controlled double-jet process is described in C. R. Berry and D. C. Skillman "Precipitation of Twinned Silver-Bromide Crystals," *Photographic Science and Engineering,* Vol. 6, p. 159 and C. R. Berry, S. T. Marino and C. F. Oster Jr. "Effects of Environment on the Growth of Silver Bromide Microcrystals",ibid. Vol. 5, p.332. A process for preparing silver halide grains at a pAg ranging from 8.6 to 9.1 and at pH no more than 4.0 is disclosed in U.S. Pat. No. 3,655,394 as a method which provides silver halide grains readily succeptible to sensitization. A silver halide emulsion prepared using this process cannot have high sensitivity even after it is chemically sensitized to an optimum extent. It has now been found that a silver halide emulsion having high sensitivity despite its small grain size can be provided where silver halide grains not greater than 0.5 μ in average size are formed in the presence of at least 10 mg/l of ammonia at a pH of 8 to 10 and at a pAg of 7 to 10 and a hydroxytetrazaindene compound is incorporated into the silver halide emulsion which contains the thus formed silver halide grains and is subjected to sulfur sensitization. The average grain size can be measured according to conventional methods, e.g., as described in the paper by A. P. H. Trivelli and W. F. Smith, entitled *Empirical Relations between Sensitometric and Size-Frequency Characteristics in Photographic Emulsion Series,* (*Photographic Journal,* 79, pp. 330 – 338 (1949)).

As the emulsion used for the process of the present invention, there may be used a monodispersed type emulsion containing silver halide grains at least 95% of which fall within the range of ± about 40% of the average grain size or there may be used a polydispersed type emulsion containing silver halide grains whose grain sizes are widely distributed from the average grain size.

As the silver halide used for the process of the present invention, any of silver bromide, silver chlorobromide, silver chloroiodide, silver chlorobromoiodide, silver bromoiodide and mixtures thereof may be used.

Of the silver halides used for the process of the present invention, a preferred one is that containing 97 mol% or more silver bromide and which has an average grain size which does not exceed 0.5 μm, or one which contains 97 mol% or more silver bromide, balance silver iodide, and which has an average grain size which does not exceed 0.5 μm. A more preferred one is one which contains 98.6 mol% or more silver bromide and which has an average grain size which does not exceed 0.5 μm.

A particularly preferred one is one which contains 98.6 mol% or more silver bromide and which has an average grain size which does not exceed 0.35 μm, or one which contains 98.6 mol% or more silver bromide, balance silver iodide, and which has an average grain size which does not exceed 0.35 μm.

The silver halide grains contained in the silver halide emulsion used in the present invention may have an octahedral, cubic or tetradecahedral crystal form. Further, they may have an irregular form such as a plate-like, spherical or polyhedral form.

As the sulfur-containing compounds used in the present invention, known sulfur sensitizers, in general, can be used. Useful sulfur-containing compounds in the present invention are compounds which can release at least one free-sulfur or thiosulfuric acid radical. For example, thiosulfates, allylthiocarbamide, thiourea, allylisothiocyanate, cystine, p-toluenethiosulfonate, rhodanine, etc., are preferred. In addition, those described in U.S. Pat. Nos. 1,574,944, 2,278,947, 2,410,689, 2,440,206, 3,187,458, 3,415,649, 3,501,313, French Pat. No. 2,058,245, etc., can be used. The sulfur-containing compound is satisfactorily added in an amount sufficient to effectively raise the intrinsic sensitivity of the silver halides. This amount varies over a wide range under various conditions but, as a standard, an amount of from about $10^{-5}$ mol to about $10^{-1}$ mol per mol of silver is preferred.

Addition of the sulfur-containing compound in an amount greater than this range does not serve to raise sensitivity of the emulsion but, conversely, lowers the sensitivity and fog tends to increase. On the other hand, addition of the sulfur-containing compound in an amount less than the range fails to effectively increase the sensitivity of the emulsion.

The sulfur-containing compound is added in a conventional manner. That is, water-soluble compounds are added as a water solution, and organic solvent-soluble compounds as a solution of a water-miscible organic solvent such as methanol, ethanol or the like.

Sensitization processes using salts of noble metals such as platinum, palladium, iridium, rhodium, ruthenium and the like as described in U.S. Pat. Nos. 2,448,060, 2,540,086, 2,566,245, 2,566,263, etc., can be used in combination with the sulfur sensitization, if desired. Also, the selenium sensitization described in U.S. Pat. No. 3,297,446 can be employed in place of, or in combination with, the sulfur sensitization.

Specific examples of hydroxytetrazaindene compounds used in the present invention are illustrated below. This listing is not to be construed as limiting the compounds used in the present invention, however.

| | |
|---|---|
| Compound I | 4-hydroxy-6-methyl-1,3,3a,7-tetrazaindene |
| Compound II | 4-hydroxy-1,3,3a,7-tetrazaindene |
| Compound III | 4-hydroxy-6-methyl-1,2,3a,7-tetrazaindene |
| Compound IV | 4-hydroxy-6-phenyl-1,3,3a,7-tetrazaindene |
| Compound V | 4-methyl-6-hydroxy-1,3,3a,7-tetrazaindene |
| Compound VI | 2,6-dimethyl-4-hydroxy-1,3,3a,7-tetrazaindene |
| Compound VII | 4-hydroxy-5-ethyl-6-methyl-1,3,3a,7-tetrazaindene |
| Compound VIII | 2,6-dimethyl-4-hydroxy-5-ethyl-1,3,3a,7-tetrazaindene |
| Compound IX | 4-hydroxy-5,6-dimethyl-1,3,3a,7-tetrazaindene |
| Compound X | 2,5,6-trimethyl-4-hydroxy-1,3,3a,7-tetrazaindene |
| Compound XI | 2-methyl-4-hydroxy-6-phenyl-1,3,3a,7-tetrazaindene |
| Compound XII | 4-hydroxy-6-ethyl-1,2,3a,7-tetrazaindene |
| Compound XIII | 4-hydroxy-6-phenyl-1,2,3a,7-tetrazaindene |
| Compound XIV | 4-hydroxy-1,2,3a,7-tetrazaindene |
| Compound XV | 4-methyl-6-hydroxy-1,2,3a,7-tetrazaindene |
| Compound XVI | 4-hydroxy-5,6-trimethylene-1,3,3a,7-tetrazaindene |
| Compound XVII | 4-hydroxy-5,6-tetramethylene-1,3,3a,7-tetrazaindene |
| Compound XVIII | 4,5-trimethylene-6-hydroxy-1,2,3a,7-tetrazaindene |
| Compound XIX | 4,5-tetramethylene-6-hydroxy-1,2,3a,7-tetrazaindene |

The hydroxytetrazaindene compound used in the present invention is satisfactorily added in an amount sufficient to effectively raise the intrinsic sensitivity of the silver halide employed. This amount widely varies depending upon the emulsion conditions but, preferably, it ranges from about 0.001 mol to about 0.5 mol, particularly from 0.03 mol to 0.5 mol, per mol of silver halide.

As to the hydroxytetrazaindene compounds represented by the above-illustrated examples, it is possible to add one compound thereof within the above-described range or to add two or more compounds in a sum amount within the above-described range to the emulsion.

These compounds are added to an emulsion in a conventional manner employed for addition to a photographic emulsion. For example, they can be added as a solution by dissolution in a suitable solvent which does not have a detrimental effect on an end-product light-sensitive material (such as water, an alkaline aqueous solution such as an aqueous solution of sodium carbonate, sodium hydroxide, barium hydroxide, etc.).

The hydrophilic colloid (vehicle of the silver halide) used in the present invention is conventional; there can be illustrated proteins (e.g., gelatin, colloidal albumin, casein, etc.), cellulose derivatives (e.g., carboxymethyl cellulose, hydroxyethyl cellulose, etc.), sugar derivatives (e.g., agaragar, sodium alginate, starch derivatives, etc.), synthetic hydrophilic colloids (e.g., polyvinyl alcohol, poly-N-vinyl pyrrolidone, polyacrylic acid copolymers, polyacrylamide, derivatives thereof, etc.). If desired, a compatible mixture of two or more thereof can be used. Gelatin is advantageously used in the present invention. Gelatin can be replaced, partly, by a synthetic high molecular weight substance, by a so-called gelatin derivative (prepared by processing gelatin with a reagent having a group capable of reacting with a functional group contained in the gelatin molecule (i.e., an amino group, imino group, hydroxy group or carboxy group)), or by a graft polymer prepared by grafting a molecular chain of another high molecular weight substance onto gelatin.

In the process of the present invention, various conventional compounds may be added to the photographic emulsion in order to prevent fogging in the production thereof, storage of light-sensitive materials formed therefrom or upon development processing. That is, there can be added azoles (e.g., benzotriazole), nitroazoles (e.g., nitroindazole, nitrobenzotriazole, etc.), halogen-substituted azoles (e.g., 5-chlorobenzimidazole, 5-bromoimidazole, 6-chlorobenzimidazole, etc.), or compounds as described in U.S. Pat. Nos. 2,131,038, 2,324,123, British Pat. No. 403,789, U.S. Pat. No. 3,251,691, Japanese Patent Publication No. 17,932/68, U.S. Pat. No. 2,394,198, Japanese Patent Publication No. 4,136/68, U.S. Pat. No. 3,236,652, British Pat. No. 623,448, U.S. Pat. Nos. 2,839,405, 3,220,839, 2,566,263, 2,597,915, 2,691,588, British Pat. No. 623,488, Japanese Patent Publication Nos. 4,941/68 and 13,496/68, and the like.

In the process of the present invention, photographic emulsion layers or other hydrophilic colloidal layers may contain, in order to raise their sensitivity or contrast, or to accelerate development, conventional additives as described in, for example, U.S. Pat. Nos. 2,441,389, 2,708,161, British Pat. No. 1,145,186, Japanese Patent Publication Nos. 10,989/70, 15,188/70, 43,435/71, 8,106/72, 8,742/72, U.S. Pat. Nos. 3,046,132 to 3,046,135, Japanese Patent Publication Nos. 9,019/70, 11,119/72, 28,325/72, U.S. Pat. No. 3,772,021, Japanese Patent Publication Nos. 27,037/70, 23,465/65, 45,541/72, 26,471/70, and 27,670/70, and the like.

Furthermore, in the process of the present invention, conventional inorganic or organic mercury compounds may be added to the photographic emulsion for the purpose of sensitization or the prevention of fog. For example, there can be used compounds as described in U.S. Pat. Nos. 2,728,664, 2,728,667, 2,728,663, 2,732,302, 2,728,665, 3,420,668, etc.

To the light-sensitive layer of the light-sensitive material to which the process of the present invention is applied there may be added, in addition to the above-described compounds, conventional various gold compounds (e.g., potassium chloroaurate, auric trichloride, etc., (see U.S. Pat. Nos. 2,399,083, 2,540,085, 2,597,856, 2,597,915), a gold (I) dithiocyanate complex salt, a gold (I) dithiosulfate complex salt, etc., (see J. Pouradier, M. C. Gadet et H. Chateau, *Electrochimie des Sels D'or I. Acides auro et aurichlorhydriques et sels correspondants, J. Chim. Phys.*, 62, 2, pp. 203 – 216 (1965)), various palladium compounds (e.g., palladium chloride (see U.S. Pat. No. 2,540,086), potassium chloropalladate (see U.S. Pat. No. 2,598,079)), reducing agents (e.g., tin chloride, phenylhydrazine, reductone, etc., (see U.S. Pat. Nos. 2,518,698, 2,419,974, 2,983,610, etc.)), or a mixture of these sensitizers.

When the average grain size of the silver halide grains contained in the photographic emulsion to which the present invention is to be applied is especially small (less than about 0.2 μm), there can be added thereto compounds as described in, e.g., British Pat. Nos. 1,316,493, 1,317,138, 1,317,139, 1,317,709, 1,297,901, West German Pat. (OLS) No. 2,235,031, etc., as a sensitizer.

When coating the result emulsion producted by the process of this invention, hardening of the emulsion can be effected in a conventional manner. As the hardening agent, there can be used, for example, aldehydes (e.g., formaldehyde, glutaraldehyde, etc.), ketones (e.g., diacetyl, cyclopentanedione, etc.), bis(2-chloroethylurea), 2-hydroxy-4,6-dichloro-1,3,5-triazine, compounds as described in U.S. Pat. Nos. 3,228,775, 2,732,303, British Pat. Nos. 974,723, 1,167,207, U.S. Pat. Nos. 3,635,718, 3,232,763, British Pat. No. 994,869, U.S. Pat. Nos. 2,732,316, 2,586,168, 3,103,437, 3,017,280, 2,983,611, 2,725,294, 2,725,295, 3,100,704, 3,091,537, 3,321,313, 3,543,292, etc., or, as an inorganic hardener, chromium alum, zirconium sulfate, etc. Also, precursors of the above-described compounds such as alkali metal bisulfite-aldehyde adducts, a methylol derivative of hydantoin, a primary aliphatic nitroalcohol, etc., may be used in place of the above-described compounds.

To the photographic emulsion to which the process of the present invention is applicable there may be added conventional surface active agents, alone or as a combination thereof. They are mainly used as a coating aid but, in some cases, they are added for improvement of the emulsion dispersion, sensitization and photographic properties, antistatic purposes and the prevention of adhesion.

These surface active agents include natural surface active agents such as saponin; nonionic surface active agents such as of the alkylene oxide series, glycerin series, glycidol series, etc.; cationic surface active agents such as higher alkyl amines, quaternary ammonium salts, heterocyclic compounds (e.g., pyridine, etc.), phosphonium compounds, sulfonium compounds, etc.; anionic surface active agents having an acidic group such as a carboxylic acid group, a sulfonic acid group, a phosphoric acid group, a sulfuric ester group, a phosphoric acid ester group, etc.; amphoteric surface active agents such as aminoacids, aminosulfonic acids, aminoalcohol sulfuric or phosphoric esters, etc.

Examples of various anionic, nonionic and amphoteric surface active agents are described in, e.g., U.S. Pat. Nos. 2,271,623, 2,240,472, 2,288,266, 2,739,891, 3,068,101, 3,158,484, 3,201,253, 3,210,191, 3,294,540, 3,415,649, 3,441,413, 3,442,654, 3,475,174, 3,545,974, German Patent Application (OLS) No. 1,942,665, British Pat. Nos. 1,077,317, 1,198,450, and books such as Ryohei Oda et al., *Synthesis and Application of Surface Active Agents* (Maki Shoten, 1964), A. W. Perry, *Surface Active Agents* (Interscience Publication Inc., 1958), J. P. Sisley, *Encyclopedia of Surface Active Agents,* Vol. 2 (Chemical Publishing Co., 1964), and the like.

When the silver halide emulsion to which the process of the present invention is applicable is used for color lightsensitive materials, conventional color image-forming couplers and dispersing agents therefor may be incorporated in the emulsion. The couplers include diffusion-resistant couplers as described in, for example, U.S. Pat. Nos. 3,277,157, 3,415,652, 3,447,928, 3,311,476, 3,408,194, 2,875,057, 3,265,506, 3,409,439, 3,551,155, 3,551,156, Japanese Application (OPI) Nos. 26,133/72, 66,836/73, U.S. Pat. Nos. 2,600,788, 2,983,608, 3,006,759, 3,062,653, 3,214,437, 3,253,924, 3,419,391, 3,419,808, 3,476,560, 3,582,322, Japanese Patent Publication No. 20,636/70, Japanese Patent Application (OPI) No. 26,133/72, U.S. Pat. Nos. 2,474,293, 2,698,794, 3,034,892, 3,214,437, 3,253,924, 3,311,476, 3,458,315, 3,591,383, Japanese Patent Publication Nos. 11,304/67, 32,461/69, U.S. Pat. Nos. 3,148,062, 3,227,554; 3,297,445, 3,253,924, 3,311,476, 3,379,529, 3,516,831, 3,617,291, 3,622,328, 3,701,783, 3,705,801, German Patent Application (OLS) No. 2,163,811, etc. These couplers can be dispersed according to the processes described in U.S. Pat. No. 2,801,171, etc.

To the silver halide photographic emulsion to which the process of the present invention is applicable can be added other conventional materials such as plasticizer for dimensional stability, a latex polymer and a matting agent, if desired. The finished emulsions are coated on a conventional suitable support.

The photographic emulsion to which the process of the present invention is applicable can be coated on a conventional rigid support such as glass, metal, porcelain, etc., or on a conventional flexible support, depending upon the proposed end use, to prepare light-sensitive materials. The emulsion is usually coated on the support in an amount ranging from about 0.1 to 2 mg silver halide per $cm^2$, though this range is not limitative.

Typical flexible supports include a cellulose nitrate film, a cellulose acetate film, a cellulose acetate butyrate film, a cellulose acetate propionate film, a polystyrene film, a polyethylene terephthalate film, a polycarbonate film, a laminate thereof, a thin glass film, paper, etc., as is commonly used for photographic light-sensitive materials. Papers coated or laminated with baryta or an α-olefin polymer, in particular, a polymer of an α-olefin having 2 to 10 carbon atoms such as polyethylene, polypropylene, ethylene-butene copolymer, etc., plastic films whose surface has been roughened to improve adhesion to other polymer substances and raise printability as described in Japanese Patent Publication No. 19,068/72, and like supports can be used.

As the support, transparent or opaque supports are selected depending upon the proposed end use of the light-sensitive materials. With transparent supports, not only colorless, transparent ones but transparent supports colored by adding dyes or pigments can be used. Opaque supports include inherently opaque ones such as paper and, in addition, ones prepared by adding dyes or pigments such as titanium oxide to a transparent film, a plastic film surface-treated according to the method described in Japanese Patent Publication No. 19,068/72, papers or plastic films to which carbon black, a dye or the like has been added to render the same completely light-intercepting, and the like. Where adhesion between the support and the photoghaphic emulsion layer is insufficient, a conventional subbing layer as an adhesive layer having adhesiveness for both the support and photographic emulsion layer can be provided. Also, to improve the adhesion, the surface of the support can be subjected to preliminary processings such as corona discharge, irradiation with ultraviolet rays, flame treatment, etc.

The process of the present invention can be applied to the sensitization of silver halide photographic emulsions for color and black-and-white light-sensitive materials. Emulsions to which the process of the present invention is applicable include, for example, emulsions for color positives, emulsions for color papers, emulsions for color negatives, color reversal emulsions (containing or free of couplers), emulsions for plate-making photographic light-sensitive materials (e.g., lithographic light-sensitive materials, etc.), emulsions for light-sensitive materials for a cathode ray tube display, emulsions for X-ray recording light-sensitive materials (radiography, particularly, materials for direct and indirect photography using a fluorescent screen), emulsions for recording electrom beams, emulsions for light-sensitive materials for microphotographs, emulsions for photomask light-sensitive materials for use in the microelectronic area, emulsions for colloid transfer processes (described in, e.g., U.S. Pat. No. 2,716,059), emulsions for silver salt diffusion transfer processes (described in, e.g., U.S. Pat. Nos. 2,352,014, 2,543,181, 3,020,155, 2,861,885, etc.), emulsions for color diffusion transfer processes (described in U.S. Pat. Nos. 3,087,817, 3,185,567, 2,983,606, 3,253,915, 3,227,550, 3,227,551, 3,227,552, 3,415,644, 3,415,645, 3,415,646, etc.), emulsions for imbibition transfer processes (described in U.S. Pat. No. 2,882,156, etc.), emulsions for silver dye bleaching processes (described in Friedman, *History of Color Photography* (American Photographic Publishers Co., 1944, especially in Chapter 24), *British Journal of Photography,* Vol. 11, pp. 308 - 309 (Apr. 7, 1964), etc.), emulsions for materials for recording print-out images (described in, e.g., U.S. Pat. No. 2,369,449, Belgian Pat. No. 704,255, etc.), emulsions for thermally developable light-sensitive materials (described in, e.g., U.S. Pat. Nos. 3,152,904, 3,312,550, 3,148,122, British Pat. No. 1,110,046, etc.), emulsions for physically developable light-sensitive materials (described in, e.g., British Pat. Nos. 920,277, 1,131,238, etc.), and the like.

The silver halide emulsion produced by process of the present invention is useful for producing lithographic light-sensitive materials for photomechanical processing, multilayer incorporated-coupler type color light-sensitive materials, in particular, color light-sensitive materials for reversal color or negative color processing, high speed black-and-white negative light-sensitive materials, light-sensitive materials for micronegatives, light-sensitive materials for micropositives, light-sensitive materials for recording X-rays (radiography), light-sensitive materials for recording electron beams, photomask light-sensitive materials for the microelectronic area, and the like. Lithographic light-sensitive materials are light-sensitive materials which enable reproduction of extremely contrasty images, usually using a hydroxybenzene as a developing agent and infectious development under low sulfite ion concentrations to thereby attain photographic reproduction of line images or half-tone dot images. A detailed description is given in Mason, *Photographic Processing Chemistry,* pp. 163 - 165 (1966).

The process of the present invention is described in more detail by the following non-limiting examples of preferred embodiments of the present invention.

EXAMPLE 1

To 750 ml of an aqueous solution containing 4% gelatin and 0.083%, 0.028% or 0.009% ammonia, 750 ml of an 1N silver nitrate aqueous solution and a 1N potassium bromide aqueous solution were simultaneously added, while stirring at 50° C over a 40 minute period while maintaining the pAg of the reaction solution at 9.6. The pH of the reaction system was 9.2, 8.8 or 8.6, respectively. Thus, there were prepared emulsions containing octahedral silver bromide grains having an average grain size of 0.35 μm (emulsion 1-a) 0.27 μm (emulsion 1-b) or 0.24 μm (emulsion 1-c), respectively. These emulsions were subjected to desalting, and 70 g of gelatin was added thereto, followed by adjusting the pAg and pH to 8.5 and 7.3, respectively, at 35° C, and adding water to make 2,000 g. Two 200 g portions of each of the thus prepared emulsions were taken out, and sodium thiosulfate pentahydrate was added to one of the two portions in an amount of 2 mg (emulsion 1-a) or 1.3 mg (emulsions 1-b and 1-c), and the emulsions ripened at 50° C for 1 hour to conduct sulfur sensitization.

Further, from each portion was taken three 50 g sub-portions, and an aqueous solution of $5 \times 10^{-2}$ mol/l 4-hydroxy-6-methyl-1,3,3a,7-tetrazaindene (compound I) in an amount of 0 ml, 4 ml or 8 ml, respectively, added to each sub-portion. Each of the resulting coating dispersion was coated on a gelatin-subbed, transparent cellulose acetate film in a dry thickness of about 4 μm to prepare photographic light-sensitive materials.

One set of the sub-portions at the end of processing contained only the tetrazaindene whereas the other set of sub-portions contained both the tetrazaindene and the thiosulfate.

Each sample was exposed for 10 seconds through a continuous optical wedge (maximum density: 4.0) and a blue filter BPN-45 (made by Fuji Photo Film Co., Ltd.), using a tungsten lamp (1,000 lux; color temperature: 2854° K). After exposure, each sample was development-processed at 20° C for 10 minutes using a Metol-ascorbic acid developer. The Metol-ascorbic acid developer was prepared by mixing 2.5 g of Metol, 10 g of ascorbic acid, 1.0 g of potassium bromide and 35.0 g of Kodalk (or Nabox) and adding water to make 1 l (pH 9.8).

Photographic density was measured by means of an automatic recording densitometer made by Fuji Photo Film Co., Ltd. Photographic density was expressed in terms of the reciprocal number of the exposure amount which provided a photographic density of fog + 0.1. The results are shown in Table 1.

TABLE 1

| | Octahedral silver bromide emulsions of various grain sizes | | | | |
|---|---|---|---|---|---|
| Test No. | pH during Formation of AgBr | Grain Size (μ) | Sodium Thiosulfate Pentahydrate (mg/mol AgBr) | Compound I ($\frac{\text{m mol}}{\text{mol AgBr}}$) | Relative Sensitivity |
| 11 | 9.2 | 0.35 | 0 | 0 | 20 |
| (compar- | | | 0 | 10.7 | 19 |
| ison) | | | 0 | 21.3 | 19 |
| 12 | 9.2 | 0.35 | 2 | 0 | 100 (standard) |
| | | | 2 | 10.7 | 174 |

TABLE 1-continued

| Test No. | Octahedral silver bromide emulsions of various grain sizes: pH during Formation of AgBr | Grain Size (μ) | Sodium Thiosulfate Pentahydrate (mg/mol AgBr) | Compound I (m mol / mol AgBr) | Relative Sensitivity |
|---|---|---|---|---|---|
| | | | 2 | 21.3 | 174 |
| 13 (comparison) | 8.8 | 0.27 | 0 | 0 | 54 |
| | | | 0 | 10.7 | 54 |
| | | | 0 | 21.3 | 54 |
| 14 | 8.8 | 0.27 | 1.3 | 0 | 100 (standard) |
| | | | 1.3 | 10.7 | 190 |
| | | | 1.3 | 21.3 | 195 |
| 15 (comparison) | 8.6 | 0.24 | 0 | 0 | 19 |
| | | | 0 | 10.7 | 23 |
| | | | 0 | 21.3 | 19 |
| 16 | 8.6 | 0.24 | 1.3 | 0 | 100 (standard) |
| | | | 1.3 | 10.7 | 200 |
| | | | 1.3 | 21.3 | 220 |

As is clear from the sensitivity values given in the above Table, it is seen that sensitivity is remarkably raised by the process of incorporating the sulfur-containing compound and the hydroxytetrazaindene compound in combination in sensitizing amounts. Thus, the light sensitivity of the emulsion subjected to sulfur sensitization and sensitization by adding the hydroxytetrazaindene compound is much higher than that of the emulsion subjected to sulfur sensitization alone, and the process of the present invention is a suitable sensitizing process for emulsions for photographic light-sensitive materials requiring high sensitivity.

REFERENCE EXAMPLE 1

Example 1 was repeated except for using an emulsion containing octahedral silver bromide grains of 0.7 μm in average grain size which was prepared in the same manner as in Example 1 except for using 750 ml of an aqueous solution containing 4% gelatin and 0.25% ammonia while the pH of the reaction system during formation of silver bromide was 9.6, in place of the emulsions (emulsions 1-a, 1-b and 1-c) comprising octahedral silver bromide grains of not greater than 0.5 μm in average grain size, and adding the sulfur-containing compound and 4-hydroxy-6-methyl-1,3,3a,7-tetrazaindene (compound I) in the amounts set forth in Table 2. The results thus obtained are shown in Table 2.

TABLE 2

| Test No. | Octahedral silver bromide emulsion of 0.7 μm in average grain size: Sodium Thiosulfate Pentahydrate (mg/mol AgBr) | Compound I (m mol / mol AgBr) | Relative Sensitivity |
|---|---|---|---|
| 21 | 0 | 0 | 19 |
| | 0 | 5.3 | 22 |
| | 0 | 21.1 | 19 |
| 22 | 2.2 | 0 | 41 |
| | 2.2 | 5.3 | 35 |
| | 2.2 | 21.1 | 34 |
| 23 | 4.4 | 0 | 74 |
| | 4.4 | 5.3 | 83 |
| | 4.4 | 21.1 | 96 |
| 24 | 8.8 | 0 | 100 (standard) |
| | 8.8 | 5.3 | 105 |
| | 8.8 | 21.1 | 123 |
| 25 | 17.5 | 0 | 81 |
| | 17.5 | 5.3 | 85 |
| | 17.5 | 21.1 | 100 |
| 26 | 35.1 | 0 | 51 |
| | 35.1 | 5.3 | 63 |
| | 35.1 | 21.1 | 100 |
| 27 | 70.2 | 0 | 42 |
| | 70.2 | 5.3 | 39 |

TABLE 2-continued

| Test No. | Octahedral silver bromide emulsion of 0.7 μm in average grain size: Sodium Thiosulfate Pentahydrate (mg/mol AgBr) | Compound I (m mol / mol AgBr) | Relative Sensitivity |
|---|---|---|---|
| | 70.2 | 21.1 | 76 |
| 28 | 140.4 | 0 | 30 |
| | 140.4 | 5.3 | 23 |
| | 140.4 | 21.1 | 30 |

As is clear from the sensitivity values given in Table 2, with the octahedral silver bromide emulsions of 0.7 μm in average grain size sulfur-sensitized to various degrees with the sulfur-containing compound, sensitivity was rather reduced or, if raised, the degree was small, even when the process of adding the hydroxytetrazaindene compound was applied thereto.

REFERENCE EXAMPLE 2

A photographic emulsion containing plate-like silver bromide grains of 1.1 μm in average grain size was prepared by a conventional single jet process, i.e., by adding a silver nitrate aqueous solution to a gelatin-containing aqueous solution of potassium bromide in the absence of ammonia while stirring and maintaining the pH at 6.3, respectively. This emulsion contained 0.30 mol silver bromide and about 45 g of gelatin per kg.

The procedures of Reference Example 1 were conducted using the above-described emulsion. The results thus obtained are shown in Table 3.

TABLE 3

| Test No. | Plate-like silver bromide emulsion of 1.1 μm in average grain size: Sodium Thiosulfate Pentahydrate (mg/mol AgBr) | Compound I (m mol / mol AgBr) | Relative Sensitivity |
|---|---|---|---|
| 31 | 0 | 0 | 20 |
| | 0 | 6.7 | 15 |
| | 0 | 26.7 | 15 |
| 32 | 5.6 | 0 | 54 |
| | 5.6 | 6.7 | 71 |
| | 5.6 | 26.7 | 50 |
| 33 | 11.1 | 0 | 100 (standard) |
| | 11.1 | 6.7 | 132 |
| | 11.1 | 26.7 | 132 |
| 34 | 22.2 | 0 | 100 |
| | 22.2 | 6.7 | 115 |
| | 22.2 | 26.7 | 115 |
| 35 | 44.4 | 0 | 71 |

TABLE 3-continued

| Test No. | Plate-like silver bromide emulsion of 1.1 μm in average grain size: Sodium Thiosulfate Pentahydrate (mg/mol AgBr) | Compound I ($\frac{m\ mol}{mol\ AgBr}$) | Relative Sensitivity |
|---|---|---|---|
| | 44.4 | 6.7 | 49 |
| | 44.4 | 26.7 | 49 |
| 36 | 88.9 | 0 | 56 |
| | 88.9 | 6.7 | 26 |
| | 88.9 | 26.7 | 18 |

As is clear from Table 3, with the emulsions containing plate-like silver bromide grains of 1.1 μm in average grain size sulfur-sensitized to various degrees with the sulfur-containing compound, sensitivity was mostly reduced and, if raised, the degree was small, even when the hydroxytetrazaindene compound was added thereto.

REFERENCE EXAMPLE 3

A photograhic emulsion containing irregular, spherical silver bromide grains of 1 μm in average grain size was prepared using an ammoniacal silver nitrate aqueous solution containing ammonia in a proportion of 2 mols per mol of silver nitrate by a conventional single jet process, while maintaining the pH at 10.0. (Hereinafter, this emulsion will be referred to as an ammoniacal silver bromide emulsion.) This emulsion contained 0.30 mol of silver bromide and about 45 g of gelatin per kg.

The same procedures as in Reference Example 1 were conducted using the above-described emulsion. The results obtained are shown in Table 4.

TABLE 4

| Test No. | Irregular spherical silver bromide emulsion of 1 μm in average grain size: Sodium Thiosulfate Pentahydrate (mg/mol AgBr) | Compound I ($\frac{m\ mol}{mol\ AgBr}$) | Relative Sensitivity |
|---|---|---|---|
| 41 | 0 | 0 | 6 |
| | 0 | 6.7 | 7 |
| | 0 | 26.7 | 7 |
| 42 | 2.5 | 0 | 10 |
| | 2.5 | 6.7 | 6 |
| | 2.5 | 26.7 | 8 |
| 43 | 5 | 0 | 14 |
| | 5 | 6.7 | 14 |
| | 5 | 26.7 | 11 |
| 44 | 10 | 0 | 100 (standard) |
| | 10 | 6.7 | 96 |
| | 10 | 26.7 | 110 |
| 45 | 20 | 0 | 76 |
| | 20 | 6.7 | 83 |
| | 20 | 26.7 | 87 |
| 46 | 40 | 0 | 39 |
| | 40 | 6.7 | 46 |
| | 40 | 26.7 | 42 |

As is clear from the sensitivity values shown in Table 4, with ammoniacal silver bromide emulsions of 1 μm in average grain size sulfur-sensitized to various degrees with the sulfur-containing compound, the sensitivity was rather reduced or, if raised, the degree was small, even when the hydroxytetrazaindene compound was added.

From Example 1, Reference Examples 1, 2 and 3, it is seen that sensitivity is extremely raised by applying the process of the present invention to an emulsion comprising grains of not more than 0.5 μm in average grain size.

EXAMPLE 2

An octahedral silver bromide emulsion of 0.2 μm in average grain size was prepared in the same manner as in Example 1 except that 750 ml of an aqueous solution containing 4% gelatin and 0.003% ammonia was used and the pH during formation of silver bromide was about 8.6. After 2.5 ml of a 0.1 wt% aqueous solution of sodium thiosulfate was added to 1000 g of the emulsion thus prepared, the emulsion was ripened at 50° C for 60 minutes to conduct sulfur sensitization. Further, this emulsion was divided into 50 g portions, and a 0.05 mol/l aqueous alkali solution of the foregoing hydroxytetrazaindene compounds II – V which contained sodium carbonate in an amount equivalent to compounds II – V, respectively, used added to each portion and the resulting dispersion coated in a dry thickness of about 4 μm on a cellulose acetate transparent film having provided thereon a gelatin subbing layer to prepare photographic light-sensitive materials.

The sensitivity of the resulting light-sensitive materials was measured in the same manner as in Example 1 and the results are shown in Table 5.

TABLE 5

| Test No. | Octahedral silver bromide emulsion of 0.2 μm in average grain size: Sodium Thiosulfate Pentahydrate (mg/mol AgBr) | Hydroxy-tetra-zaindene Compound | Amount Added ($\frac{m\ mol}{mol\ AgBr}$) | Relative Sensitivity |
|---|---|---|---|---|
| 51 (Comparative Example) | 6.7 | — | 0 | 100 (standard) |
| 52 | 6.7 | II | 5.3 | 270 |
| | 6.7 | II | 10.6 | 282 |
| | 6.7 | II | 21.3 | 224 |
| | 6.7 | II | 42.7 | 200 |
| 53 | 6.7 | III | 5.3 | 195 |
| | 6.7 | III | 10.6 | 195 |
| | 6.7 | III | 21.3 | 151 |
| 54 | 6.7 | IV | 5.3 | 302 |
| | 6.7 | IV | 10.6 | 302 |
| | 6.7 | IV | 21.3 | 437 |
| | 6.7 | IV | 42.7 | 302 |
| 55 | 6.7 | V | 5.3 | 246 |
| | 6.7 | V | 10.6 | 145 |

As is clear from the sensitivity values given in Table 5, extremely great increases in light-sensitivity were observed in every case by incorporating hydroxytetrazaindene compounds in the sulfur-sensitized fine grain octahedral silver bromide emulsion.

EXAMPLE 3

A cubic silver bromoiodide emulsion containing grains of 0.3 μm in average grain size, not more than 95% in number of which fell within the range of ± 40% of the average grain size, and containing 0.25 mol% silver iodide, was prepared in the same manner as in Example 1 except for using 750 ml of an aqueous solution containing 4% gelatin and 0.028% ammonia forming grains while maintaining the pAg and the pH at 7.9 and 8.8, respectively, at 50° C. 300 g of this emulsion was removed and 2 ml of a 1% sodium thiosulfate pentahydrate aqueous solution was added thereto, followed by ripening at 50° C for 1 hour to conduct sulfur sensitization.

Further, 50 g portions of this emulsion were removed and a $5 \times 10^{-2}$ mol/l aqueous solution of 4-hydroxy-6-methyl-1,3,3a,7-tetrazaindene (Compound I) was added thereto in an amount of 0 ml, 4 ml and 8 ml, respectively. Then, each coating solution was coated in a dry thickness of about 4 μm on a cellulose acetate transparent film having provided thereon a gelatin subbing layer to prepare photographic light-sensitive materials.

The same procedures as in Example 1 were conducted using the above-described light-sensitive materials. The sensitivity values obtained are shown in Table 6.

TABLE 6

Sulfur-sensitized cubic silver bromoiodide emulsion of 0.3 μm in average grain size

| Test No. | Sodium Thiosulfate . Pentahydrate (mg/mol AgBr) | Compound I ($\frac{\text{m mol}}{\text{mol AgBr}}$) | Relative Sensitivity |
|---|---|---|---|
| 71 | 180 | 0 | 100 (standard) |
| | 180 | 10.7 | 141 |
| | 180 | 21.3 | 152 |

From the sensitivity values in Table 6, it is clear that sensitivity can remarkably be raised by the process of incorporating the hydroxytetrazaindene compound in the sulfur-sensitized fine grain cubic silver bromoiodide emulsion.

EXAMPLE 4

An emulsion containing cubic silver bromide grains of 0.2 μm in average grain size, not more than 95% in number of which fell within the range of ± 40% of the average grain size, was prepared in the same manner as in Example 1 except for using 750 ml of an aqueous solution containing 4% gelatin and 0.009% ammonia maintaining the pAg at 7.9 at 50° C. The pH of the reaction system during formation of silver bromide was about 8.6. The same procedures as in Example 3 were conducted using the above-described emulsions. The sensitivity values thus obtained are shown in Table 7.

TABLE 7

Sulfur-sensitized cubic silver bromide emulsion of 0.2 μm in average grain size

| Test No. | Sodium Thiosulfate . Pentahydrate (mg/mol AgBr) | Compound I ($\frac{\text{m mol}}{\text{mol AgBr}}$) | Relative Sensitivity |
|---|---|---|---|
| 81 | 90 | 0 | 100 (standard) |
| | 90 | 10.7 | 263 |
| | 90 | 21.3 | 295 |

From the sensitivity values in Table 7, it is clear that sensitivity can remarkably be raised by the process of incorporating the hydroxytetrazaindene compound in the sulfur-sensitized fine grain cubic silver bromide emulsion.

EXAMPLE 5

A silver bromoiodide emulsion containing octahedral grains of 0.29 μm in average grain size (silver iodide content: 1 mol%) was prepared in the same manner as in Example 1 except for the following points (1) – (6): (1) 750 ml of an aqueous solution containing 4% gelatin and 0.083% ammonia was used; (2) the pH of the reaction system during formation of silver bromoiodide was 9.2; (3) 18.3 mg of sodium thiosulfate pentahydrate was added per mol of silver halide, and the emulsion was ripened at a temperature of 55° C for 70 minutes to conduct sulfur sensitization; (4) after the completion of ripening and before coating, 4-hydroxy-6-methyl-1,3,3a,7-tetrazaindene, (Compound I) was added in an amount of 0.16 m mol, 32 m mols, 64 m mols or 128 m mols per mol of silver halide to prepare samples; (5) each sample was then subjected to exposure, without a blue filter, to a xenon lamp (100,000 lux; color temperature: 4800° K) for 1/100 sec, or to a tungsten lamp (1,000 lux; color temperature: 2854° K) for 10 sec, respectively; (6) after exposure, each sample was development-processed at 27° C for 3 minutes employing the following developer.

| Formulation of Developer | |
|---|---|
| Metol | 5.37 g |
| Sodium Sulfite | 54.4 g |
| Hydroquinone | 11.5 g |
| Borax . Pentahydrate | 16 g |
| Sodium Hydrogen Sulfite | 3.8 g |
| Sodium Hydroxide | 10.54 g |
| Potassium Bromide | 5 g |
| Water to make | 1 l |

The results of various measurements on the samples are shown in Table 8.

TABLE 8

Octahedral silver bromoiodide emulsion of 0.29 μm in average grain size having been sulfur-sensitized (sodium thiosulfate . pentahydrate: 36.6 mg/mol AgBrI)

| Test No. | Exposure Time | Compound I ($\frac{\text{m mol}}{\text{mol AgBr}}$) | Relative Sensitivity |
|---|---|---|---|
| 91 | 10 sec | 0 | 100 (standard) |
| | | 16 | 195 |
| | | 32 | 251 |
| | | 64 | 295 |
| | | 128 | 339 |
| 92 | 1/100 sec | 0 | 100 (standard) |
| | | 16 | 166 |
| | | 32 | 209 |
| | | 64 | 230 |
| | | 128 | 235 |

From the sensitivity values shown in Table 8, it is clear that a remarkable increase in sensitivity can be observed, both under the conditions of exposing at low illumination intensity for a long time and under the conditions of exposing with high illumination intensity for a short time, by the process of incorporating the hydroxytetrazaindene compound in the sulfur-sensitized fine grain octahedral silver bromoiodide emulsion.

EXAMPLE 6

With a silver bromoiodide emulsion (silver iodide content: 1 mol%) containing octahedral grains of 0.29 μm in average grain size, prepared in the same manner as in Example 5 except for adding 18.3 mg of sodium thiosulfate.pentahydrate and 9.8 mg of chloroauric acid per mol of silver halide at the initial stage of ripening (for ripening, the temperature of the system was increased to 55° C then sodium thiosulfate was added (starting point of ripening)), there were obtained the sensitivity values shown in Table 9.

TABLE 9

Octahedral silver bromoiodide emulsion of 0.29 μm in average grain size sensitized with a sulfur compound and a gold compound in combination

| Test No. | Exposure Time | Compound I ($\frac{\text{m mol}}{\text{mol AgBrI}}$) | Relative Sensitivity |
|---|---|---|---|
| 101 | 10 sec | 0 | 100 (standard) |
| | | 16 | 110 |
| | | 32 | 126 |

TABLE 9-continued

Octahedral silver bromoiodide emulsion of 0.29 μm in average grain size sensitized with a sulfur compound and a gold compound in combination

| Test No. | Exposure Time | Compound I ( m mol / mol AgBrI ) | Relative Sensitivity |
|---|---|---|---|
| | | 64 | 155 |
| | | 128 | 178 |
| 102 | 1/100 sec | 0 | 100 (standard) |
| | | 16 | 126 |
| | | 32 | 138 |
| | | 64 | 151 |
| | | 128 | 155 |

From the sensitivity values shown in Table 9, it is clear that a remarkable increase in sensitivity can be observed, both under the conditions of exposing with low illumination intensity for a long time and under the conditions of exposing with high illumination intensity for a short time, by the process of incorporating the hydroxytetrazaindene compound in the fine grain octahedral type silver bromoiodide emulsion sensitized with a sulfur compound and a gold compound in combination. Exposure and development were otherwise as in Example 5.

EXAMPLE 7

With a silver bromoiodide grain emulsion (silver iodide content: 1 mol%) containing cubic grains of 0.29 μm in average grain size, prepared in the same manner as in Example 5 except for forming silver halide grains while maintaining the pAg at 7.9 at 50° C and adding 18.3 mg of sodium thiosulfate.pentahydrate and 9.8 mg of chloroauric acid at the initial stage of ripening as in Example 6 except for using a temperature of 50° C, there were obtained the sensitivity values shown in Table 10. Exposure and development were otherwise as in Example 5.

TABLE 10

Cubic silver bromoiodide emulsion of 0.29 μm in average grain size sensitized with the sulfur compound and the gold compound in combination

| Test No. | Exposure Time | Compound I ( m mol / mol AgBrI ) | Relative Sensitivity |
|---|---|---|---|
| 111 | 10 sec | 0 | 100 (standard) |
| | | 16 | 155 |
| | | 32 | 162 |
| | | 64 | 170 |
| | | 128 | 224 |
| 112 | 1/100 sec | 0 | 100 (standard) |
| | | 16 | 132 |
| | | 32 | 132 |
| | | 64 | 135 |
| | | 128 | 145 |

From the sensitivity values shown in Table 10, it is clear that a remarkable increase in sensitivity can be obtained by the process of incorporating the hydroxytetrazaindene compound in the fine grain cubic form silver bromoiodide emulsion sensitized by a sulfur compound and a gold compound in combination.

While the invention has been described in detail and with reference to specific embodiments thereof, it will be apparent to one skilled in the art that various changes and modifications can be made therein without departing from the spirit and scope thereof.

What is claimed is:

1. In a process for preparing a sulfur sensitized ammoniacal silver halide photographic emulsion whose average grain size does not exceed 0.5μm, the improvement which comprises forming the silver halide grains in contact with at least 10 mg/l ammonia at a pH of 8 to 10 and a pAg of 7 to 10 and thereafter chemically ripening said emulsion in contact with a sulfur-containing compound and also after said grain formation but before during or after the chemical ripening incorporating in said silver halide emulsion at least one hydroxytetrazaindene compound represented by the following general formulae (I) or (II):

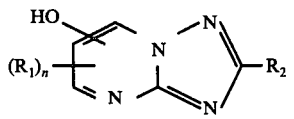

(I)

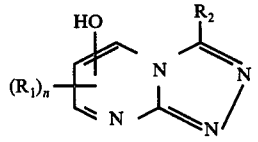

(II)

wherein $R_1$ and $R_2$ each represents a hydrogen atom, an aliphatic group or an aromatic group, and *n* represents 1 or 2; said sulfur-containing compound and said hydroxytetrazaindene compound being present in sensitizing amounts.

2. The process as described in claim 1, wherein said silver halide is one of silver bromide, silver bromoiodide, silver chlorobromide, silver chlorobromoiodide, silver chloroiodide, or a mixture thereof.

3. The process as described in claim 1, wherein said silver halide contains 97 mol% or more of silver bromide.

4. The process as described in claim 1, wherein said silver halide contains 97 mol% or more of silver bromide, and the balance silver iodide.

5. The process as described in claim 1, wherein said silver halide contains 98.6 mol% or more of silver bromide, and the balance silver iodide.

6. The process as described in claim 1, wherein the average grain size of said silver halide does not exceed 0.35 μm.

7. The process as described in claim 6, wherein said silver halide contains 97 mol% or more of silver bromide.

8. The process as described in claim 6, wherein said silver halide contains 98.6 mol% or more of silver bromide, and the balance silver iodide.

9. The process as described in claim 1, wherein said silver halide emulsion contains grains having a crystal form of at least one of an octahedral form, a cubic form, a tetradecahedral form, a spherical form, a plate-like form, or a polyhedral form.

10. The process as described in claim 6, wherein said silver halide emulsion contains grains having a crystal form of at least one of an octahedral form, a cubic form, or a tetradecahedral form.

11. The process as described in claim 1, wherein the silver halide grains are formed in the presence of gelatin.

12. The process as described in claim 1, wherein the content of the at least one hydroxytetrazaindene compound represented by the general formulae (I) or (II) ranges from about 0.001 mol to about 0.5 mol per mol of silver halide.

13. The process as described in claim 1, wherein the content of the at least one hydroxytetrazaindene compound represented by the general formulae (I) or (II) ranges from 0.03 mol to 0.5 mol per mol of silver halide.

14. The process as described in claim 1, wherein the hydroxytetrazaindene compound represented by general formulae (I) or (II) is at least one compound selected from 4-hydroxy-6-methyl-1,3,3a,7-tetrazaindene, 4-hydroxy-1,3,3a,7-tetrazaindene, 4-hydroxy-6-methyl-1,2,3a,7-tetrazaindene, 4-hydroxy-6-phenyl-1,3,3a,7-tetrazaindene, 4-methyl-6-hydroxy-1,3,3a,7-tetrazaindene, 2,6-dimethyl-4-hydroxy-1,3,3a,7-tetrazaindene, 4-hydroxy-5-ethyl-6-methyl-1,3,3a,7-tetrazaindene, 2,6-dimethyl-4-hydroxy-5-ethyl-1,3,3a,7-tetrazaindene, 2,5,6-trimethyl-4-hydroxy-1,3,3a,7-tetrazaindene, 2-methyl-4-hydroxy-6-phenyl-1,3,3a,7-tetrazaindene, 4-hydroxy-6-ethyl-1,2,3a,7-tetrazaindene, 4-hydroxy-6-phenyl-1,2,3a,7-tetrazaindene, 4-hydroxy-1,2,3a,7-tetrazaindene, 4-methyl-6-hydroxy-1,2,3a,7-tetrazaindene, 4-hydroxy-5,6-trimethylene-1,3,3a,7-tetrazaindene, 4-hydroxy-5,6-tetramethylene-1,3,3a,7-tetrazaindene, 4,5-trimethylene-6-hydroxy-1,2,3a,7-tetrazaindene, 4,5-tetramethylene-6-hydroxy-1,2,3a,7-tetrazaindene, and 4-hydroxy-5,6-dimethyl-1,3,3a,7-tetrazaindene.

15. The process as described in claim 1, wherein said hydroxytetrazaindene compound represented by general formulae (I) or (II) is at least one compound selected from 4-hydroxy-6-methyl-1,3,3a,7-tetrazaindene, 4-hydroxy-1,3,3a,7-tetrazaindene, 4-hydroxy-6-methyl-1,2,3a,7-tetrazaindene, 4-hydroxy-6-phenyl-1,3,3a,7-tetrazaindene and 4-methyl-6-hydroxy-1,3,3a,7-tetrazaindene.

16. The process as described in claim 14, wherein the content of said hydroxytetrazaindene compound ranges from 0.03 mol to 0.5 mol per mol of silver halide.

17. The process as described in claim 15, wherein the content of said hydroxytetrazaindene compound ranges from 0.03 mol to 0.5 mol per mol of silver halide.

18. A silver halide photographic emulsion prepared according to the process described in claim 1.

19. A photographic emulsion as described in claim 18, wherein the average grain size of said silver halide does not exceed 0.35 $\mu$m.

20. The silver halide photographic emulsion as described in claim 19, which contains at least one hydroxytetrazaindene compound represented by general formulae (I) or (II) in an amount of from about 0.001 mol to about 0.5 mol per mol of silver halide.

21. The silver halide photographic emulsion as described in claim 19, which contains at least one hydroxytetrazaindene compound represented by general formulae (I) or (II) in an amount of from 0.03 mol to 0.5 mol per mol of silver halide.

22. The silver halide photographic emulsion as described in claim 19, which contains the sulfur-containing compound in an amount of from about $10^{-5}$ mol to about $10^{-1}$ mol per mol of silver halide.

23. A photographic element comprising a support and at least one sulfur-sensitized silver halide photographic emulsion thereon prepared by the process as described in claim 1.

* * * * *